US006212828B1

(12) United States Patent
McArthur, Jr.

(10) Patent No.: US 6,212,828 B1
(45) Date of Patent: Apr. 10, 2001

(54) FOOT-LEVEL AISLE CLOSURE PANEL FOR TELESCOPING SEATING SYSTEM WITH INTERMEDIATE STEP

(76) Inventor: Louis Robert McArthur, Jr., 105 Mill St., Cornith, NY (US) 12822

( * ) Notice: Subject to any disclaimer, the term of this patent is extended or adjusted under 35 U.S.C. 154(b) by 0 days.

(21) Appl. No.: 09/408,795

(22) Filed: Sep. 30, 1999

(51) Int. Cl.[7] ..... E04H 3/12
(52) U.S. Cl. ..... 52/9; 52/8
(58) Field of Search ..... 52/6, 9, 8

(56) References Cited

U.S. PATENT DOCUMENTS 5,661,928 9/1997 Beu .
5,784,835 7/1998 McArthur .
5,822,929 * 10/1998 Guiles et al. ..... 52/9

OTHER PUBLICATIONS

Article by Donald G. Scandett, entitled: Bleacher Comfort, published in Athletic Business, vol. 22, #12, p. 86 in Dec., 1998 Issue.

* cited by examiner

*Primary Examiner*—Christopher T. Kent
(74) *Attorney, Agent, or Firm*—Heslin & Rothenberg, P.C.; Wayne F. Reinke, Esq.

(57) ABSTRACT

Apparatus and method for covering at least a portion of a foot-level aisle of a telescoping seating system. The telescoping seating system includes a plurality of seating levels, each seating level above a lowest seating level including a foot member, the foot-level aisle including an intermediate stair member vertically adjacent an upper surface of the foot member of a seating level below a highest seating level. A closure panel is included for covering the at least a portion of the foot-level aisle including the intermediate stair member when the telescoping seating system is in a closed position. In one embodiment, the closure panel is removably coupled to an outer surface of the telescoping seating system. In another embodiment, the closure panel is coupled to an underside of each foot member through a guide mechanism, the closure panels covering the foot-level aisle at the seating level immediately below.

18 Claims, 5 Drawing Sheets

FOOT-LEVEL AISLE CLOSURE PANEL FOR TELESCOPING SEATING SYSTEM WITH INTERMEDIATE STEP

BACKGROUND OF THE INVENTION

1. Technical Field

The present invention generally relates to telescoping seating systems. More particularly, the present invention relates to apparatus to deter climbing on telescoping seating systems at the aisles when closed.

2. Background Information

Telescoping seating systems have come a long way from the "bleachers" in elementary and high school gymnasiums many people grew up with. An increased desire for longevity and safety have led to many changes and improvements. For example, recent safety improvements include the creation of clear walkways or aisles running top to bottom at predetermined intervals across the telescope seating systems. These walkways can be at seat level or foot level. When the walkway is at foot level, the seats and risers are removed in the area of the aisle and the foot members at each seating level act as steps. As one skilled in the art will know, the risers support the seats and close off the opening underneath the seat to the supporting structure below. However, when closed, these aisles create a "ladder effect" attracting children and others to climb the telescoping seating system, creating safety and maintenance issues. In the past, this problem has been addressed by the addition of sheet metal panels fixed to the seating level above, which were generally effective at deterring such climbing.

However, even more recent regulations require that new telescoping seating systems include intermediate stair members between foot level steps. These intermediate stair members do not allow for fixed aisle panels, obstructing the panels during opening and closing of the telescoping seating system. Thus, manufacturers offering telescoping seating systems with intermediate stair members do not offer the panels, again creating a "ladder effect," reawakening the safety and maintenance concerns.

Thus, a need exists for a way to address the climbing problem with respect to telescoping seating systems that include intermediate level stair members in foot level aisles.

SUMMARY OF THE INVENTION

Briefly, the present invention satisfies the need to address the climbing problem with respect to telescoping seating systems that include intermediate level stair members in foot level aisles by providing a closure panel therefor that is not obstructed by the intermediate level stair members.

In accordance with the above, it is an object of the present invention to provide a closure panel to reduce the "ladder effect" presented by telescoping seating systems with intermediate stair members in foot-level aisles.

The present invention provides, in a first aspect, apparatus for covering at least a portion of a foot-level aisle of a telescoping seating system. The telescoping seating system includes a plurality of seating levels, each seating level above a lowest seating level including a foot member, the foot-level aisle including an intermediate stair member vertically adjacent an upper surface of the foot member of a seating level below a highest seating level. The apparatus comprises a closure panel for covering the at least a portion of the foot-level aisle including the intermediate stair member when the telescoping seating system is in a closed position.

The present invention provides, in a second aspect, a telescoping seating system, comprising a plurality of of seating levels, each seating level above a lowest seating level including a foot member, at least one support member coupled to a lower surface of a first foot member of a first seating level and extending downward toward an upper surface of a second foot member of a second seating level directly below the first seating level, and at least one wheel coupled to the at least one support member. The upper surface substantially supports the wheel between a closed position and an opened position of the telescoping seating system. The system further comprises a foot-level aisle, comprising an intermediate stair member vertically adjacent an upper surface of the second foot member, and a closure panel coupled to the first seating level for covering the foot-level aisle at the second seating level including the intermediate stair member when the telescoping seating system is in the closed position.

The present invention also comprises, in a third aspect, a telescoping seating system, comprising a plurality of seating levels, each seating level above a lowest seating level including a foot member, a foot-level aisle, and a closure panel removably coupled to an outer surface of the telescoping seating system when in a closed position for covering the foot-level aisle. The foot-level aisle comprises an intermediate stair member vertically adjacent an upper surface of each foot member below a highest seating level.

The present invention further comprises, in a fourth aspect, a method of covering at least a portion of a foot-level aisle of a telescoping seating system including a plurality of seating levels, each seating level above a lowest seating level including a foot member, and an intermediate stair member vertically adjacent an upper surface of each foot member below a highest seating level. The method comprises coupling a closure panel to the telescoping seating such that it is closable and the at least a portion of the foot-level aisle coverable by the closure panel without the closure panel being obstructed by the intermediate stair member at each seating level.

These, and other objects, features and advantages of this invention will become apparent from the following detailed description of the various aspects of the invention taken in conjunction with the accompanying drawings.

BEST MODE FOR CARRYING OUT THE INVENTION

Figure 1:
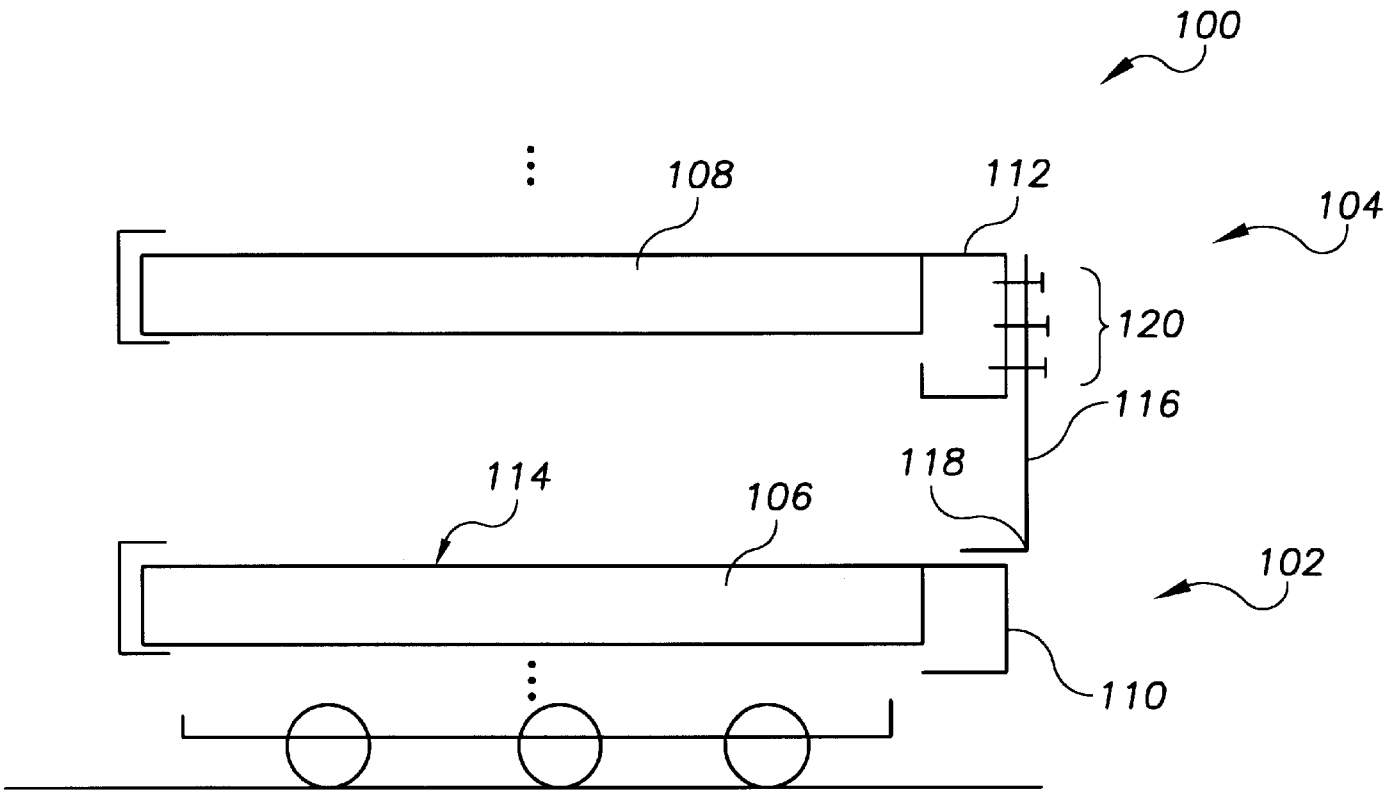
FIG. 1 PRIOR ART
FIG. 1 is a simplified cross-sectional view of a prior art telescoping seating system having a foot level aisle and fixed panel.

FIG. 1 is a simplified cross-sectional view of a portion 100 of a prior art telescoping seating system taken at a foot level aisle. The supporting structure of the telescoping seating system has been omitted for simplification. Also, since FIG. 1 is taken at a foot-level aisle, no seats are shown, but it will be understood that seating exists on either side of the aisle. Portion 100 comprises a lower seating level 102 and the next higher seating level 104. Each level above a lowest seating level (not shown)includes a foot member (106 and 108, respectively), and attached nosebeam (110 and 112, respectively). The top surface 114 of foot member 106 is used as the first step in the aisle. A sheet metal panel 116 includes a 90° bend 118, and is fixed to nosebeam 112 by fasteners 120 (e.g., nuts and bolts). Panel 116 moves with seating level 104 between opened and closed positions. However, it can be seen that if an intermediate stair member were added over surface 1 14, panel 116 would run into it and prevent opening and closing of the telescoping seating system.

Figure 2:
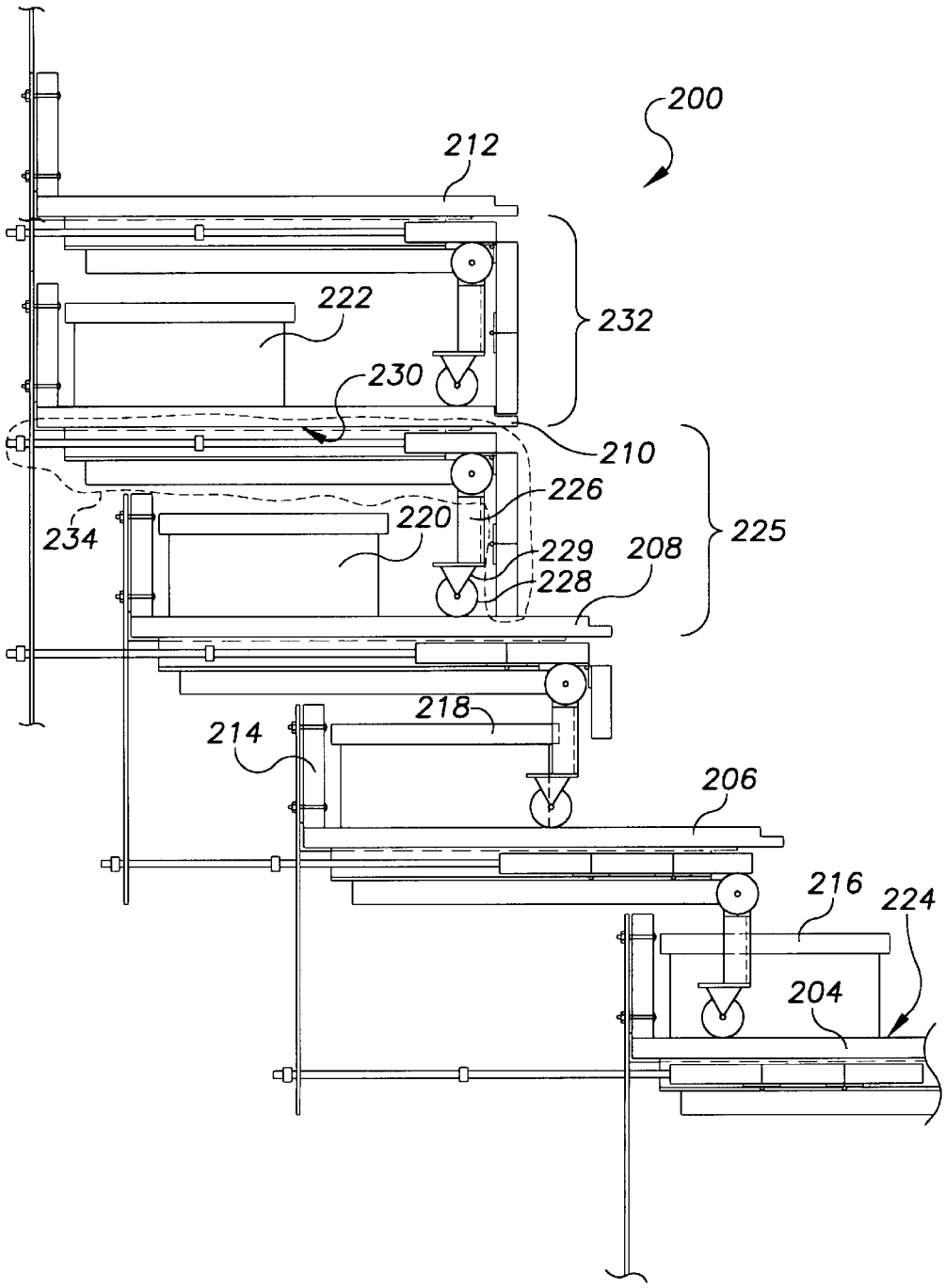
FIG. 2 is a simplified cross-sectional view of a partially opened telescoping seating system in accordance with an exemplary embodiment of the invention.

FIG. 2 is a cross-sectional view of a simplified section of an exemplary telescoping seating system 200 in accordance with the present invention, taken at a foot level aisle. The supporting structure for system 200 has been omitted for simplification. It should also be noted that since FIG. 2 is taken at a foot level aisle, no seats are shown, but seating exists on either side of the aisle. Shown in FIG. 2 are a plurality of foot members (204, 206, 208, 210 and 212), one for each seating level. A foot member is so named because it is the surface a person's feet would rest on when seated at a given seating level. As used herein, the term "seating level" refers to a level of seating of a telescoping seating system, comprising a seat member (absent in the aisles), foot member, heel board member (e.g., heel board member 214), etc. The heel boards serve as a rear stop for the feet of those seated a given level when in use. It will be understood that system 200 could be mobile or fixed, and that the foot members and heel members, for example, could be separate or integrated.

Also shown in FIG. 2 are intermediate stair members 216, 218, 220, and 222, each situated vertically adjacent an upper surface of the respective foot member (e.g., upper surface 224 of foot member 204). The intermediate stair members create another layer of steps for the foot level aisle, aside from the foot members. However, since there are no more seating levels to traverse above a highest seating level, no intermediate stair member is placed over the foot member of the highest seating level. Each seating level (e.g., seating level 225) above a lowest or ground seating level, preferably includes a wheel support member 226 coupled to a wheel 228, which allows each seating level to be supported at and between opened and closed positions of the telescoping seating system. Aside from serving as a back stop for feet, the heel boards (e.g., heel board 214) can also serve as stops for the wheels (e.g., wheel 228) when closing the telescoping seating system.

As used herein, the term "wheel" refers to any device that allows the thing to which it is attached (here, e.g., wheel holder 229) to move relative to an adjacent surface it comes into contact with (here, e.g., foot member 208). Also, as used herein, the term "couple" is intended to refer to one member being directly connected to another, or being connected to the other through one or more intermediary members.

Figure 3:
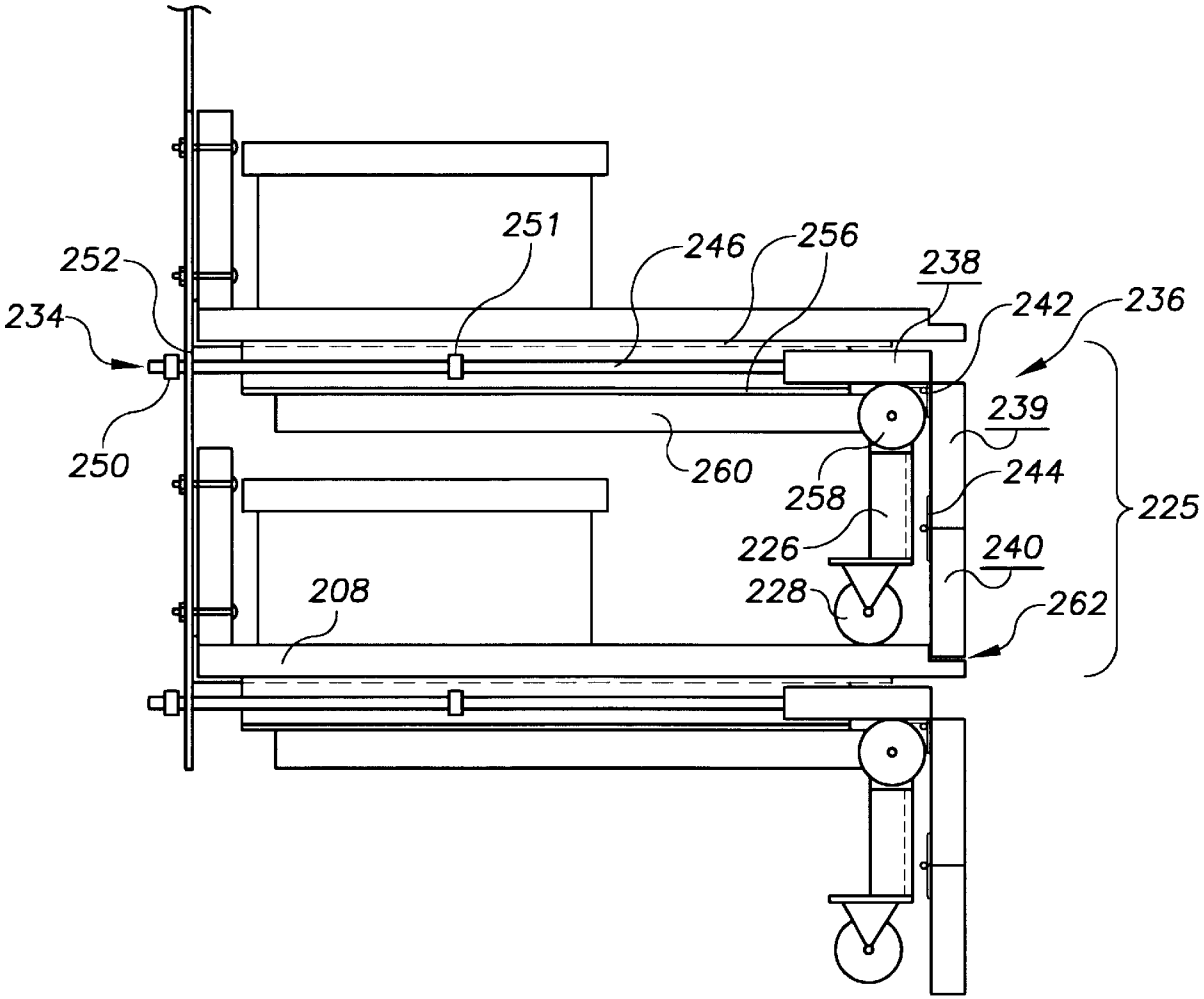
FIGS. 3–4 depict details of a guide mechanism for a retractable closure panel in accordance with the exemplary embodiment of FIG. 2.

Each of the support members is coupled to the underside of the foot member of the next highest seating level through a closure panel and guide system. For example, wheel support member 226 is coupled to the underside 230 of foot member 210 of seating level 232 through closure panel and guide system 234. FIG. 3 is an enlarged view of the area of seating level 225 in order to better show closure panel and guide system 234. Exemplary closure panel 236 comprises three individual panels 238–240, with panels 238 and 239 being connected by hinge member 242, and panels 239 and 240 likewise being connected by hinge member 244. The panels could be comprised of any number of materials, such as, for example, sheet metal, wood and/or plastic. In one embodiment, the panels are sheet metal with a plastic covering.

The guide system comprises rod 246 (e.g., a steel rod) coupled to rear panel 238 at the front. The length of rod 246 depends on the dimensions of the closure panel used, as well as the width of the particular telescoping seating system. Stop 250 holds the rod to a rear structural component 252 of the telescoping seating system, while stop 251 prevents closure panel 236 from being forced too far backward toward structural component 252. A track 256 (described more fully with respect to FIG. 4) guides closure panel 236 over a roller 258 coupled to bracket 260 between a closed position and opened position of the telescoping seating system. Preferably, the foot members (e.g., foot member 208) include a notch (e.g., notch 262) for receiving closure panel 236.

Connecting rod 246 to the closure panel allows it to retract into track 256 (i.e., open) and close automatically with the opening and closing of the telescoping seating system, respectively. The location of the rod and connected closure panel stays relatively unchanged compared to a fixed point, but the movement of telescoping seating system causes the appearance of movement of the panel. It will be understood, however, that the closure panel need not automatically retract and/or close. Further, the closure panel could be, for example, spring loaded, or electronically or hydraulically controlled separate from or in conjunction with the telescoping seating system. For example, the closure panel could be motorized and opened/closed by a switch or by infra-red remote control.

Figure 4:
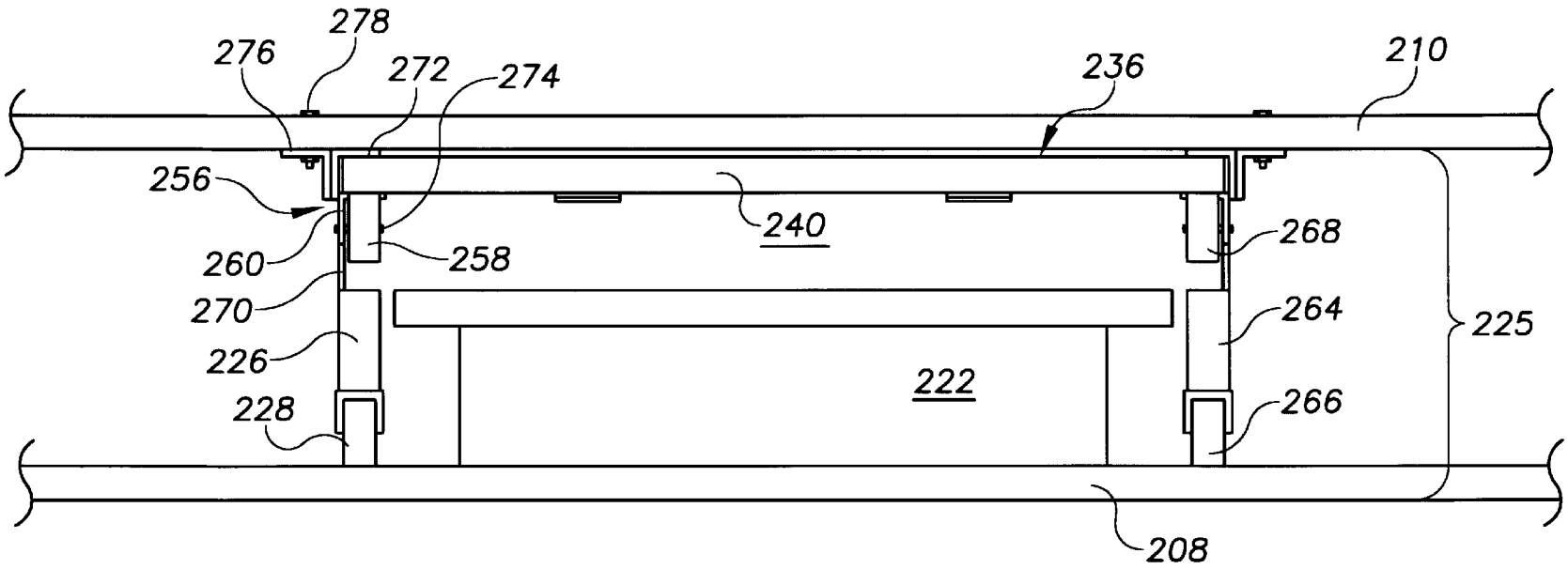

FIG. 4 is a front view of seating level 225 from FIG. 3 with closure panel 236 in a fully retracted position. As shown best in FIG. 4, intermediate stair member 222 is situated such that it is between support member 226 and a corresponding support member 264 with coupled wheel 266 and roller 268. The physical track 256 guiding the closure panel between the opened and closed positions comprises, for example, angled member 260 (coupled to support member 226 via extension 270, and which is part of bracket 260 from FIG. 3) and another angled member 272, together creating a squared U-shaped track. Angled member 272 is connected to angled member 260 by, for example, welding if the angled members are metal. Angled member 260 includes a pin 274 on which roller 258 rotates. Finally, a mounting member 276 is connected to member 272 by, for example, welding, and secured to the underside of foot member 210 by, for example, a bolt 278. It will be understood that a similar configuration is present with respect to support member 264 and the other corresponding members on the other side.

Figure 5:
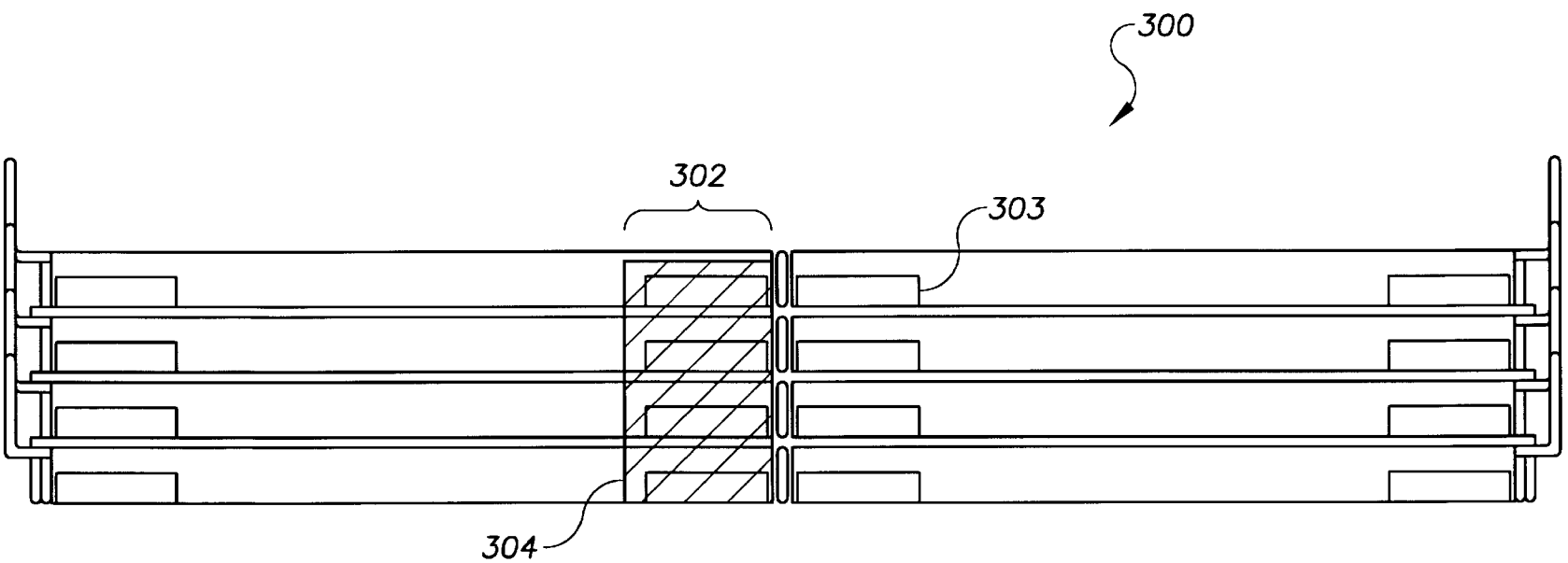
FIG. 5 is a front view of a telescoping seating system in accordance with another exemplary embodiment of the invention.

FIG. 5 is a front view of another exemplary embodiment of a telescoping seating system 300 in accordance with the present invention. System 300 is shown in FIG. 5 in the closed position. Each foot-level aisle (e.g., foot-level aisle 302) includes intermediate stair members (e.g., stair member 303) as in FIG. 2. Covering foot-level aisle 302 is a closure panel 304. The intermediate stair members of aisle 302 are shown for understanding, but are actually covered by panel 304. The closure panel in this exemplary embodiment does not travel with the system during opening and closing, but instead, is coupled to the system after closing and removed prior to opening. Although there could be multiple closure panels to cover the aisle at each seating level individually, shown in FIG. 5 is a single closure panel (e.g., closure panel 304) covering the entire aisle from top to bottom. The closure panels of this embodiment are preferably made of a flexible but sturdy material, such as, for example, heavy canvas, leather or plastic, to simplify storage. However, other materials could be used, such as, for example, sheet metal. The closure panels are preferably coupled to the telescoping seating system by removable fasteners, such as, for example, snaps or hook-and-loop fasteners. However, the panels could also be coupled by screws or nuts and bolts. Such fasteners would slow down the process of getting the panels on and off, but they could be used. Any type of fastener that is not permanent could be used.

While several aspects of the present invention have been described and depicted herein, alternative aspects may be effected by those skilled in the art to accomplish the same objectives. Accordingly, it is intended by the appended claims to cover all such alternative aspects as fall within the true spirit and scope of the invention.

What is claimed is:

1. Apparatus for covering at least a portion of a foot-level aisle of a telescoping seating system, the telescoping seating system including a plurality of seating levels, each seating level above a lowest seating level including a foot member, the foot-level aisle including an intermediate stair member vertically adjacent to an upper surface of the foot member of a seating level below a highest seating level, the apparatus comprising:

a closure panel for covering the at least a portion of the foot-level aisle including the intermediate stair member when the telescoping seating system is in a closed position, wherein the closure panel is not obstructed by the intermediate stair member during opening and closing of the seating system.

2. The apparatus of claim 1, wherein the closure panel comprises a plurality of hingedly connected panels.

3. The apparatus of claim 1, wherein the closure panel is adapted to be coupled to an outer surface of the telescoping seating system when in the closed position.

4. The apparatus of claim 3, wherein the closure panel is adapted to be removably coupled to the outer surface of the telescoping seating system when in the closed position.

5. The apparatus of claim 1, wherein the closure panel is adapted to be coupled to an underside of a foot member of the another seating level directly above the seating level via a guide mechanism.

6. The apparatus of claim 5, wherein the closure panel comprises a plurality of hingedly connected panels, and wherein the guide mechanism comprises at least one roller for the plurality of hingedly connected panels to traverse between the closed position and an opened position of the telescoping seating system.

7. The apparatus of claim 5, wherein the closure panel comprises a plurality of hingedly connected panels, and wherein the guide mechanism comprises at least one roller for the plurality of hingedly connected panels to traverse between the closed position and an opened position.

8. A telescoping seating system, comprising:

a plurality of seating levels, each seating level above a lowest seating level including a foot member;

at least one support member coupled to a lower surface of a first foot member of a first seating level and extending downward toward an upper surface of a second foot member of a second seating level directly below the first seating level;

at least one wheel coupled to the at least one support member, wherein the upper surface substantially supports the wheel between a closed position and an opened position of the telescoping seating system;

a foot-level aisle, comprising an intermediate stair member vertically adjacent an upper surface of the second foot member; and a closure panel coupled to the first seating level for covering the foot-level aisle at the second seating level including the intermediate stair member when the telescoping seating system is in the closed position, wherein the closure panel is not obstructed by the intermediate stair member during opening and closing of the seating system.

9. The telescoping seating system of claim 8, wherein the closure panel comprises a retractable closure panel.

10. The apparatus of claim 9, wherein the guide mechanism allows the closure panel to automatically retract upon opening the telescoping seating system.

11. The apparatus of claim 9, wherein the guide mechanism allows the closure panel to automatically close upon closing the telescoping seating system.

12. The telescoping seating system of claim 9, wherein the retractable closure panel is coupled to the first seating level through a guide mechanism.

13. The telescoping seating system of claim 12, wherein the retractable closure panel comprises a plurality of hingedly connected panels, and wherein the guide mechanism comprises at least one roller for the plurality of hingedly connected panels to traverse between the opened position and the closed position.

14. The telescoping seating system of claim 9, wherein the at least one support member comprises a first support member coupled to the lower surface adjacent a first side of the intermediate stair member and a second support member coupled to the lower surface adjacent a second side of the intermediate stair member opposite the first side, and wherein the retractable closure panel is coupled to the first support member and the second support member through the guide system.

15. A telescoping seating system, comprising:

a plurality of seating levels, each seating level above a lowest seating level including a foot member;

a foot-level aisle, comprising an intermediate stair member vertically adjacent an upper surface of each foot member below a highest seating level; and a closure panel removably couplable to an outer surface of the telescoping seating system when in a closed position for covering the foot level aisle.

16. A method of covering at least a portion of a foot-level aisle of a telescoping seating system including a plurality of seating levels, each seating level above a lowest seating level including a foot member, and an intermediate stair member vertically adjacent an upper surface of each foot member below a highest seating level, the method comprising:

coupling a closure panel to the telescoping seating system such that the telescoping seating system is closable and the at least a portion of the foot-level aisle coverable by the closure panel without the closure panel being obstructed by the intermediate stair members.

17. The method of claim 16, wherein the coupling comprises removably coupling the closure panel to an outer surface of the telescoping seating system after closing the telescoping seating system, thereby covering the at least a portion of the foot-level aisle.

18. The method of claim 16, wherein the coupling comprises coupling the closure panel to an underside of a foot member of a first seating level through a guide mechanism, the at least a portion of the foot-level aisle at a second seating level directly below the first seating level being coverable by the closure panel when the telescoping seating system is in a closed position.

* * * * *

UNITED STATES PATENT AND TRADEMARK OFFICE

CERTIFICATE OF CORRECTION

PATENT NO. : 6,212,828 B1
DATED : April 10, 2001
INVENTOR(S) : McArthur, Jr.

It is certified that error appears in the above-identified patent and that said Letters Patent is hereby corrected as shown below:

Title page,
Inventorship Address, delete "Cornith" and insert -- Corinth --

Signed and Sealed this

Eleventh Day of December, 2001

*Attest:*

Nicholas P. Godici

NICHOLAS P. GODICI
*Acting Director of the United States Patent and Trademark Office*

*Attesting Officer*